United States Patent [19]

Shanks

[11] 4,351,261

[45] Sep. 28, 1982

[54] RISER RECOIL PREVENTER SYSTEM

[75] Inventor: Forrest E. Shanks, DeSoto, Tex.

[73] Assignee: Sedco, Inc., Dallas, Tex.

[21] Appl. No.: 901,520

[22] Filed: May 1, 1978

[51] Int. Cl.[3] ..... B63B 35/44

[52] U.S. Cl. ..... 114/264; 175/5; 175/27; 92/10; 92/143; 267/126

[58] Field of Search ..... 114/213, 256, 264, 265; 175/5, 7, 8, 27; 254/93 R, 172, 173 B; 92/10; 166/355; 91/4

[56] References Cited

U.S. PATENT DOCUMENTS

| | | | |
|---|---|---|---|
| 3,653,635 | 4/1972 | Bates et al. | 254/172 |
| 3,687,205 | 8/1972 | Mori | 175/27 |
| 3,714,995 | 2/1973 | Hanes et al. | 254/172 |
| 3,943,868 | 3/1976 | Person et al. | 114/264 |
| 3,983,706 | 10/1976 | Kalinowski | 175/7 |
| 4,004,532 | 1/1977 | Reynolds | 114/256 |

*Primary Examiner*—Trygve M. Blix
*Assistant Examiner*—Jesus D. Sotelo
*Attorney, Agent, or Firm*—Hubbard, Thurman, Turner & Tucker

[57] ABSTRACT

A recoil system and method for supporting a marine riser which is extended from offshore well head equipment to a floating platform are disclosed. The purpose of the recoil system is to prevent a violent collisin of the riser with the platform when the riser becomes separated from the well head equipment during a planned or an emergency disconnect operation. Upon disconnection of the riser from the well head equipment, the lifting force applied to the riser is reduced to a predetermined lower level and the riser is retracted to an elevated position above the well head equipment to permit unobstructed excursions of the riser. A variable lifting force is applied to the riser to maintain the riser substantially in equilibrium in the retracted position as the floating platform heaves relative to the riser in response to wave action. The riser is supported by a tensioner assembly which includes a hydraulic cylinder having a housing member attached to the platform, a movable piston dividing the housing member into a high pressure hydraulic chamber and a low pressure hydraulic chamber, and a rod connected to the piston and coupled to the riser for applying a lifting force to the riser in response to pressurization of the hydraulic pressure chamber. Collision of the riser against the floating platform is prevented by apparatus which includes a reservoir of compressed gas and a valve connected intermediate the compressed gas reservoir and the low pressure hydraulic chamber for selectively applying a pneumatic or pneumatic over hydraulic pressure load to the piston in opposition to the hydraulic pressure load when the riser is disconnected from the well head equipment.

5 Claims, 7 Drawing Figures

RISER RECOIL PREVENTER SYSTEM

BACKGROUND OF THE INVENTION

1. Field of the Invention

The present invention relates generally to offshore drilling and production equipment and in particular to motion compensating apparatus for supporting a marine riser of the type extending from offshore well head equipment to a floating platform.

2. Description of the Prior Art

In performing both drilling and production operations on an offshore well, it is necessary to provide a marine riser connection between well head equipment and a surface facility to provide a stable conduit through which a drill string, production fluids and electrical power may be conveyed between the ocean floor and the surface facility. The surface facility may be a tanker, a drill ship, a barge, a floating platform or a platform which is fixed to the ocean floor. The marine riser cannot withstand compression loading and therefore must be supported under tension at the water surface to prevent its collapse. This is easily accomplished when the surface facility is a production platform which is fixed to the ocean floor, but a more difficult problem is presented when the water depth is so great that the surface facility must be floating and hence is not stationary.

Floating surface facilities such as drilling vessels and other apparatus employed in the drilling of oil wells offshore are generally large and very expensive. Thus it is important that the drilling operations of such a vessel continue with as little interruption as possible. In the offshore environment, sea and weather conditions are generally the determining factor as to whether or not drilling or production operations can continue. The equipment utilized is generally designed to permit continuation of operations in as adverse conditions as possible.

The drilling operations in water depths exceeding several hundred feet are generally performed from a floating, semi-submersible platform, or from a drilling ship, which are supported by buoyancy and not from the sea bottom. Riser tensioner systems have been developed for offshore drilling and production activities to compensate for the rise and fall of the floating vessel. Conventional tensioner systems have commonly comprised hydraulic compensating cylinders connected to cables to the riser at symmetrically arranged tie points. Such riser equipment is generally designed to permit continuation of operations during adverse conditions. However, during periods of severe sea conditions it becomes necessary to terminate the drilling or production operations and disconnect the riser from the well head equipment in order to prevent a catastrophic loss of the well, riser and drill string.

According to conventional procedures, at the onset of adverse conditions the drilling operations are terminated and the drill string is pulled in and stored aboard the vessel. Production operations, during adverse conditions, are discontinued. After that operation, the marine riser is disconnected from the well head equipment and is also disassembled and stored until sea conditions permit resumption of operations. The recovery and subsequent deployment of the drill string and riser involve disassembly, storage and re-assembly operations which are expensive and time consuming. Furthermore, there are occasions when weather conditions become so severe that the drilling vessel must be removed from the production or drilling field as quickly as possible to prevent damage or loss of the drill ship. In such circumstances there may not be sufficient time to recover and store the drill string and riser. This situation becomes progressively more serious in deeper waters where unusually long drill strings and risers are employed. Therefore improved methods and apparatus are needed for retrieving and handling marine risers during emergency disconnect situations.

A problem has arisen which is related to the disconnection of the marine riser while it is undergoing tension loading. In a typical arrangement, the upper end of the marine riser is coupled to the floating platform by means of a telescoping slip joint. When the riser is disconnected, the slip joint collapses very rapidly as the riser is lifted upwardly by the tensioner assembly. Under certain circumstances, a violent collision may occur if the slip joint is permitted to completely collapse or retract during disconnection of the riser.

As the search for petroleum resources advances into deeper waters, the riser length and load increases and thus the tension load imposed upon the riser by the tensioner assembly is increased. For example, when drilling in approximately 4,000 feet of water, the tension requirement will be approximately 500 to 600 kips for a conventional marine riser. The terminal velocity imparted to 4,000 feet of riser by a tension load of 500 to 600 kips is sufficient to cause a violent, destructive impact of the slip joint against the vessel support and rotary table if the slip joint is permitted to collapse.

Although some tensioner assemblies have been equipped with velocity limiter apparatus which have performed well when using relatively short risers, such arrangements are not adequate for preventing slip joint collapse caused by the disconnection of the relatively longer and heavier riser which is undergoing substantially larger tension loading. Because of the serious risk of damage to the drilling vessel and related or production drilling equipment and the risk of serious injury to vessel personnel which may be caused by the violent collision of the riser against drilling vessel, it is imperative to provide an improved riser tensioner assembly which is operable to apply a tension load to the marine riser during normal drilling or production operations and which is operable for relieving the tension load to prevent a violent collision of the riser against the drilling vessel during a planned disconnect or an emergency disconnect operation.

SUMMARY OF THE INVENTION

It is an object of the present invention to provide marine riser tensioner system which in addition to its usual function of applying a tension load to the riser is operable for suspending the riser at an elevated position above well head equipment to permit unobstructed excursions of the riser relative to the well head equipment and for compensating for heaving of the support platform relative to the riser to maintain the suspended riser substantially in equilibrium in its retracted position so that the riser can be safely carried in suspension when it becomes necessary or desirable to disconnect and leave the production site. With the heave compensation provided by the tensioner equipment of the invention, it is possible to terminate drilling operations, disconnect the marine riser, and suspend the riser from the floating platform or drill ship without the delay associated with the conventional riser pulling procedure.

It is a further object of the present invention to provide a riser recoil preventer assembly for limiting the displacement of the riser to prevent its collision with the drill ship in response to disconnection of the marine riser while it is undergoing tension loading by the tensioner assembly.

According to an important aspect of the invention, a tensioner assembly is provided for maintaining a tension load on the riser and further includes means for preventing a collision of the riser with the platform as the riser is disconnected from the well head equipment while undergoing tension loading. Upon disconnection of the riser from the well head equipment, the lifting force applied to the riser is reduced to a predetermined lower level and the riser is retracted to an elevated position above the well head equipment to permit unobstructed excursions of the riser. A variable lifting force is applied to the riser to maintain the riser substantially in equilibrium in the retracted position as the floating platform heaves relative to the riser in response to wave action.

In a preferred embodiment of the invention, the riser is supported by a tensioner assembly which includes a hydraulic cylinder having a housing member attached to the platform, a movable piston dividing the housing member into a high pressure hydraulic chamber and a low pressure hydraulic chamber, and a rod connected to the piston and coupled to the riser for applying a lifting force to the riser in response to pressurization of the high pressure hydraulic chamber. Collision of the riser against the floating platform is prevented by apparatus which includes an auxiliary reservoir of compressed gas and valve means connected intermediate the auxiliary reservoir and the low pressure hydraulic chamber for selectively applying a pneumatic or pneumatic over hydraulic pressure load to the piston in opposition to the hydraulic pressure load when the riser is disconnected from the well head equipment.

According to an important feature of the invention, the lifting force is provided by a hydraulic accumulator connected in fluid communication with the high pressure hydraulic chamber of the cylinder and a source of high pressure compressed gas connected in fluid communication with the hydraulic accumulator for maintaining the pressure load on the hydraulic fluid. Upon disconnection of the riser, the high pressure source of compressed gas is locked out with respect to the hydraulic accumulator and the auxiliary source of compressed gas is connected to the low pressure hydraulic chamber to oppose the hydraulic pressure load. The pressure and volume of the auxiliary compressed gas source is closely controlled to limit the stroke of the piston which is driven into an equilibrium position which is determined by the pressure and volume of the compressed gas in the hydraulic accumulator. Because of the variable force exerted by the compressed gas in the accumulator and in the regulated compressed gas source, the hydraulic cylinder provides heave compensation as the platform is displaced relative to the riser in response to wave action.

In a preferred embodiment, the lifting force exerted by the tensioner assembly is reduced by substituting an auxiliary accumulator and compressed gas source in the place of the primary accumulator and compressed gas source. In this arrangement, a first volume of compressed gas is contained within the primary reservoir and accumulator at a pressure level which is sufficient to maintain tension loading on the marine riser while it is attached to well head equipment, and a second volume of compressed gas is contained within the auxiliary reservoir and accumulator at a pressure level which is less than the pressure level of the gas in the primary reservoir but which is sufficient to retract the riser upon disconnection of the riser from the well head equipment and to maintain the suspended riser substantially in equilibrium at the retracted position at the platform heaves and falls in response to wave movements.

The foregoing and other objects, advantages and features of the invention will hereinafter appear, and for purposes of illustration, but not of limitation, an exemplary embodiment of the subject invention is shown in the various views of of the appended drawing.

DETAILED DESCRIPTION

Figure 1:
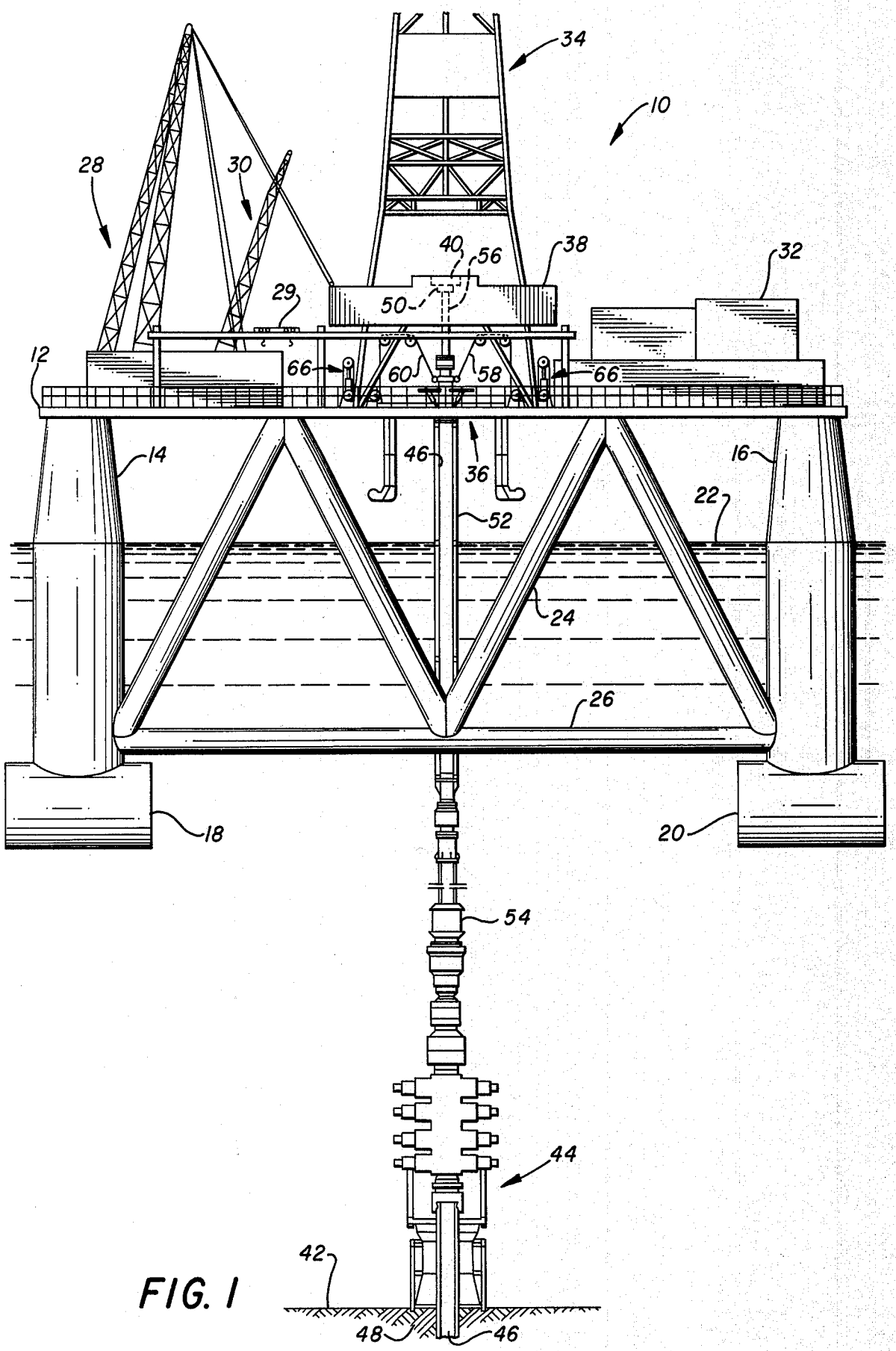
FIG. 1 is an elevation view of a semi-submersible drilling platform and a marine riser connected to well head equipment and coupled to the semisubmersible drilling platform by means of a tensioner assembly constructed according to the teachings of the present invention.

In the description which follows, like parts are marked throughout the specification and drawing with the same reference numerals, respectively.

Referring now to FIG. 1 of the drawing, the invention is incorporated in a semi-submersible offshore drilling vessel 10, the general features of which are illustrated in FIG. 1 of the drawing. The semi-submersible offshore drilling vessel 10 includes a platform or main deck 12 supported by spaced stability columns 14, 16 and buoyant hulls 18, 20. The drilling vessel 10 is illustrated in a submerged drilling position in a body of water 22. Tubular trusses 24, 26 interconnect the hulls 18, 20, the stability columns 14, 16 and the deck 12. A large capacity revolving crane 28 mounted on one side of the deck 12 for handling heavy equipment such as a BOP stack. A traveling hoist 29 is provided for transporting heavy equipment such as a BOP from a storage position to a launching position. A small revolving crane 30 is provided for lifting and handling drill string sections and riser sections. Crew quarters 32 and associated drilling equipment are also mounted on the main deck 12.

A conventional drilling derrick 34 is mounted above a moon pool opening 36 formed in a central part of the platform 12. Supported intermediate the moon pool and the derrick is a pipe handling platform 38 which includes a conventional rotary table 40.

Figure 2:
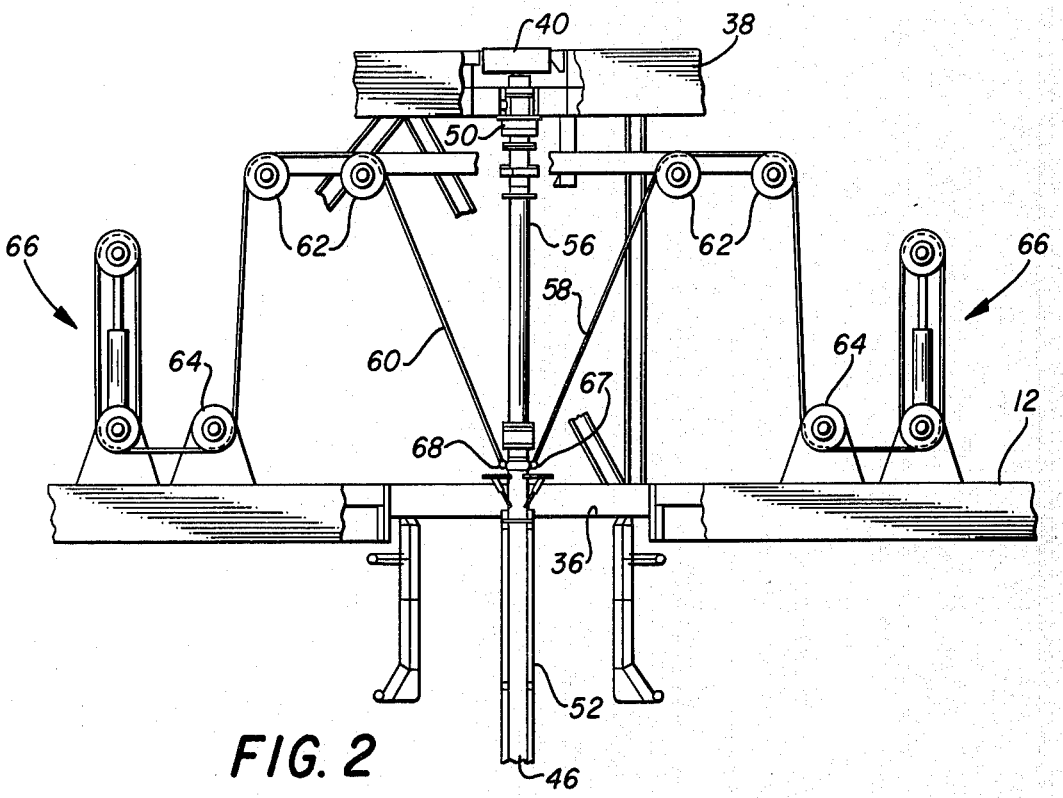
FIG. 2 is an elevation view of a portion of FIG. 1 which illustrates the coupling of the marine riser to the tensioner assembly.

Referring now to FIGS. 1 and 2, the semi-submersible drilling vessel 10 is stationed above a drilling or production site 42 in which conventional well head equipment 44 is imbedded. The well head equipment 44 includes a conventional BOP, having upper and lower stack sections and related subsea control equipment. A drill string 46 extends from a layer of producing strata 48 through the well head equipment and to the pipe handling platform 38 where it is connected to the rotary table 40 by means of rotary coupling apparatus 50. The drill string 46 is enclosed within a marine riser string 52 which is connected at its lower end to the well head equipment 44 by means of a ball joint assembly 54.

According to conventional practice, the upper end of the riser 52 is coupled to the rotary table 40 by means of a telescopic slip joint 56 which permits heaving of the drilling vessel 10 relative to the upper end of the riser 52. The telescopic slip joint 56 is shown in its half-stroke position. The full stroke range of the telescopic joint 56 may be as much as forty-five to fifty-five feet. Because the riser string 52 cannot withstand compression loading, a lifting force is applied to the upper end of the riser string to induce tension loading in the riser to prevent its collapse.

As can best be seen in FIG. 2, the upward lifting force is transmitted by a plurality of cables 58, 60 which are disposed in reeved engagement with sheaves 62, 64 and coupled to a tensioner assembly 66 constructed according to the teachings of the present invention. Although only two tensioner assemblies 66 are shown, it should be understood that as many as twelve or more tensioner assemblies 66 may be coupled to the riser string 52 for maintaining the tension loading. The cables 58, 60 are preferably attached to the upper end of the riser 52 at symmetrically spaced tie points 67, 68 so that the load is divided equally among the tensioner assemblies.

Figure 3:
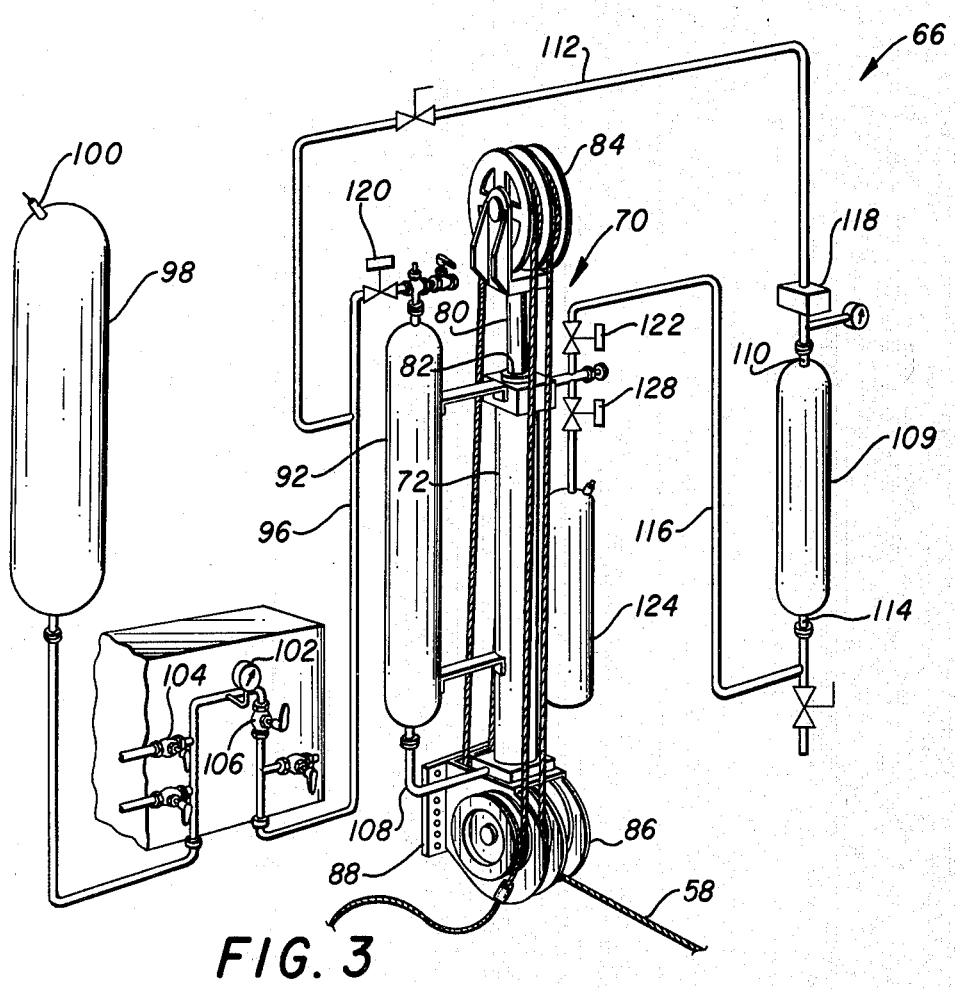
FIG. 3 is an isometric view of a tensioner assembly constructed according to the teachings of the present invention.
Figures 5, 7:
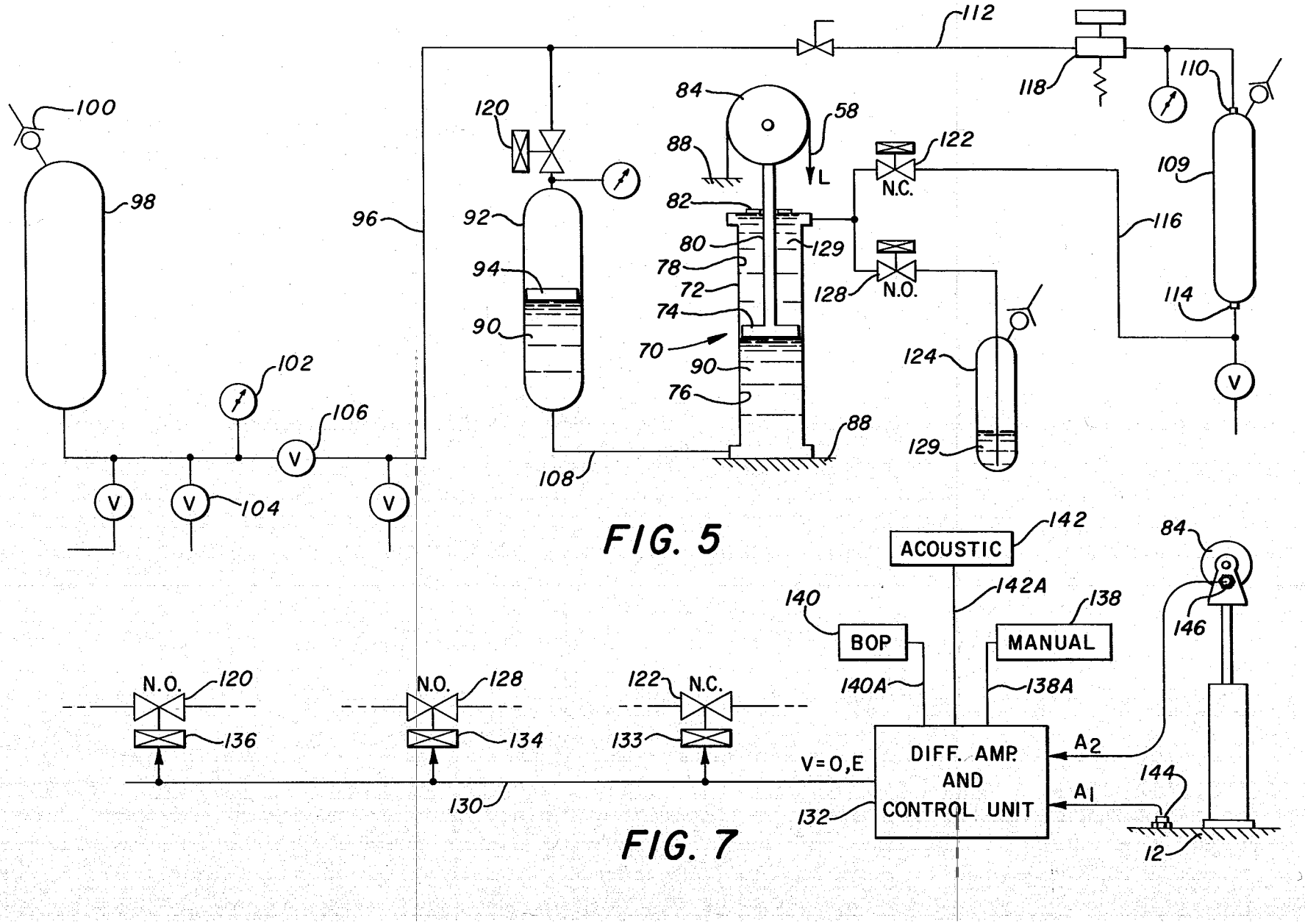
FIG. 5 is a schematic illustration of the apparatus shown in FIG. 3.
FIG. 7 is an electrical schematic diagram of a typical control circuit for controlling the operation of the riser recoil preventer system of the present invention.

Referring now to FIGS. 3 and 5, a first preferred embodiment of the tensioner assembly 66 is illustrated. The tensioner assembly 66 performs the dual functions of transmitting a lifting force through the cable 58 to maintain a tension load on the riser 52 during a drilling operation, and also performs a riser recoil preventer function which limits the retraction of the telescopic slip joint 56 so that a violent collision of the slip joint against the rotary table will be prevented when the riser is disconnected from the well head equipment 44. The lifting force is developed by means of a hydraulic cylinder 70 having a housing 72 and a movable piston 74 dividing the housing into a high pressure hydraulic chamber 76 and a low pressure hydraulic chamber 78. A rod 80 passes in sliding engagement with a seal 82 and through the low pressure hydraulic chamber 78 where it is connected to the piston 74 for driving a load in response to pressurization of the high pressure hydraulic chamber 76. The power transmission cable 58 is coupled in reeved engagement with a traveling sheave 84 and to a fixed sheave 86 in a double purchase arrangement which provides a mechanical advantage. The traveling sheave 84 is attached to the piston rod 80 and the fixed sheave 86 is attached to a base portion 88 of the hydraulic cylinder 70.

A lifting force L is developed in the power transmission cable 58 as the high pressure hydraulic chamber 76 is pressurized. Hydraulic fluid 90 in the high pressure hydraulic chamber 76 is maintained under pressure by a hydraulic accumulator 92. The accumulator 92 is the air/oil type and may include a floating, unsealed piston 94 which separates hydraulic fluid in the bottom half of the accumulator from compressed air in the top half of the accumulator. The top half of the accumulator 92 is connected through a pneumatic pressure line 96 to a high pressure reservoir 98 of compressed gas. The reservoir 98 may consist of a bank of several identical air bottles connected through a check valve 100 to a compressor (not shown) for maintaining a predetermined high pressure level in the bottles. A gauge 102 is provided for monitoring the pressure of the reservoir 98. Various additional valves 104, 106 are connected to the pneumatic pressure line 96 to provide for venting of the reservoir 98 and for connection to other pneumatic operated equipment.

Hydraulic fluid 90 is conveyed through a hydraulic pressure line 108 to the bottom of the cylinder 72 where it is connected in fluid communication with the high pressure hydraulic chamber 76. The piston 74 is equipped with the usual piston rings for providing a sliding interface seal between the piston and the walls of the cylinder housing 72. When the tensioner assembly is being operated in the drilling mode, hydraulic fluid 90 is forced from the accumulator 92 through the pressure line 108 and into the high pressure chamber 76 where a hydraulic force is presented to the face of the piston 74. The pressure developed on the floating piston 94 in the accumulator 92 maintains the hydraulic fluid in the accumulator and in the high pressure chamber 76 under pressure as the volume of the hydraulic pressure chamber changes. When the floating platform 10 heaves downwardly with respect to the riser, the cylinder housing 72 is displaced downwardly with respect to the piston 74, thereby increasing the volume of the high pressure chamber 76. The pressure exerted by the compressed air in the accumulator 92 causes additional hydraulic fluid 90 to flow from the accumulator to the hydraulic cylinder to completely fill the high pressure chamber 76 and maintain a pressure load on the piston 74. As the floating platform 10 heaves upwardly with respect to the riser, the cylinder housing 72 is displaced upwardly relative to the piston 74 and the hydraulic fluid 90 in the pressure chamber 76 is forced from the chamber into the accumulator 92. As this occurs, the volume of air in the accumulator 92 is compressed as the hydraulic fluid is returned.

It may be desirable in some circumstances because of adverse weather conditions or because of a planned operation to disconnect the riser 52 and upper BOP stack from the well head equipment 44. As previously discussed, because of the very high tension loading applied to the riser string 52, disconnection of the riser string while it is undergoing the tension loading presents a serious risk of damage to equipment and injury to personnel if the telescopic slip joint 56 is permitted to be driven into a violent collision with the rotary table in response to the disconnection under tension loading. According to an important feature of the present invention, the retraction and displacement of the slip joint 56 is limited by relieving or reducing the lifting force applied to the riser string 52 by the tensioner assemblies.

In a preferred embodiment of the invention, this function is carried out by means of an auxiliary reservoir 198 of compressed gas having an inlet port 110 connected in fluid communication with a source of compressed gas, for example the high pressure reservoir 98 through a pneumatic pressure line 112 and having an outlet port 114 connected in fluid communication through a pneumatic pressure line 116 to the low pressure chamber 78 for applying a pneumatic over hydraulic pressure load on the piston 74 in opposition to the hydraulic pressure load during the disconnect mode of operation.

The pressure of the compressed gas and the auxiliary reservoir 109 is controlled by means of a regulator 118 for maintaining the pressure of the auxiliary reservoir 109 at a predetermined lower level relative to the high pressure reservoir 98. The pressure of the compressed gas in the auxiliary reservoir 109 is regulated to the value which will cause the piston 74 to stroke and reach equilibrium with the suspended riser load after retracting the riser to an elevated position above the well head equipment 44 to permit unobstructed excursions of the riser without interfering or contacting the well head equipment as the floating drilling platform heaves in response to wave movements. This also limits the retraction of the telescopic slip joint so that a collision of the slip joint with the rotary table does not occur.

The required volume and pressure for the compressed air in the auxiliary reservoir 109 may be determined by applying the adiabatic relation $P_1V_1^k$ equals $P_2V_2^k$ where $P_1$ and $V_1$ refer to the pressure and volume of the compressed gas in the chamber 92 prior to stroke and $P_2$, $V_2$ refer to the pressure and volume of chamber 92 after the stroke. The change in volume from $V_1$ to $V_2$ is directly related to the stroke of the piston. If the stroke is specified, the pressure $P_2$ can be determined using the adiabatic relation above. The amount of stroke has been specified, the pressure on the 76 side of the piston, $P_2$, has been found and knowing the area of the piston, the force on the 76 side of the piston can be found. The force equals pressure, $P_2$, multiplied by the area. To bring the system into eqilibrium at the specified stroke the force action on the 78 side of the piston must be equal to the force on the 76 side of the piston. Part of the force on the 78 side of the piston is supplied by the suspended weight of the riser. Knowing the diameter of the rod 80, the area of the piston which applies a force in the required direction can be found. This area is the total piston 74 area minus the area of the rod 80. The pressure that must be applied to counteract the force on the 76 side of the piston is found by dividing the force on the 76 side, less the suspended weight of the riser, by the available piston area on the 78 side. This is the pressure the riser recoil regulator 118 is set. The superscript k refers to the ratio of the constant pressure to the constant volume of specific heat for air at zero pressure (approximately 1.1). Assuming that the accumulator is biased to operate the telescopic slip joint at mid-range stroke, the volume of the pneumatic pressure chamber for each accumulator may be readily determined. Furthermore, the ratio of the telescopic joint displacement to piston stroke is also known so that the exact pressure chamber volume which corresponds to a given displacement or retraction of the telescopic slip joint can be accurately determined. By knowing the fixed volume of the auxiliary reservoir 109 together with the desired final volume of the high pressure chamber 76, the exact pressure setting of the regulator 118 can be predicted according to the pressure-volume relationship expressed above. For example, at twenty foot slip joint stroke the air volume in the pressure chamber 76 is seventy gallons ($V_1$). For a twelve foot lift off or retraction of the riser there is a corresponding three foot tensioner stroke of the piston 74 with the resulting pneumatic volume of the pressure chamber 78 equal to 94 gallons ($V_2$). Since the initial pressure ($P_1$) is known, the desired pressure in the low pressure chamber 78 may be easily determined. The riser recoil preventer system pressure is equal to the equilibrium pressure times the effective piston area less the suspended weight of the riser divided by the effective piston area.

The accumulator 92 is pressurized by the high pressure reservoir 98 through a solenoid operated, normally open valve 120 during the drilling mode of operation. The auxiliary reservoir 109 is connected to the low pressure chamber 78 through a normally closed solenoid operated pilot valve 122 which prevents interference with the piston during the drilling mode of operation. As can also be seen in FIG. 5, a reservoir 124 of hydraulic fluid is connected through a normally open pilot operated valve 128 to provide a closely controlled amount of hydraulic fluid to the back side of the piston to lubricate the piston seals and to provide for proper operation of the seals. Thus the low pressure hydraulic chamber 78 is filled with low pressure hydraulic fluid 129 during normal operation, but may be partially filled with high pressure air during a disconnect operation as the piston 74 strokes.

During the drilling mode of operation, the pilot operated valves 120 and 128 are in the normally open condition so that the hydraulic cylinder 70 can apply tension to the riser string 52 in the usual manner. However, upon the execution of a planned disconnect of the riser or upon an emergency disconnect of the riser, the normally open valves 120, 128 are closed and the normally closed valve 122 is opened thereby imposing a pneumatic load on the piston 74 in opposition to the hydraulic load to provide for limited retraction of the marine riser and to prevent the complete collapse of the telescopic slip joint.

Actuation of the pilot operated valves 120, 122 and 128 may be controlled manually or through an automatic system as shown in FIG. 7 of the drawing. In FIG. 7, an actuating signal 130 is generated by a control unit 132 which has a number of inputs. The control unit 132 preferably includes a logic circuit (not shown) in which an actuating voltage V is produced which is sufficient to operate the solenoids 133, 134 and 136 of the valves 122, 128 and 120 respectively, in response to a command signal from any one of several sources. For example, a command signal 138A may be generated by the manual switching means 138 which is preferably used during a planned disconnect mode of operation. A command signal 140A may be generated by circuitry 140 carried in the BOP stack or a signal 142A by an acoustic transmitter 142 connected to the BOP stack to provide an indication that a disconnection of the riser has occurred. On the drilling platform itself, a command signal may be derived from the outputs $A_1$, $A_2$ of a pair of accelerometers 144, 146 connected to the drilling platform of main deck 12 and to the traveling sheave 84 respectively. The control unit 132 preferably includes a differential amplifier circuit connected to receive the electrical signals $A_1$ and $A_2$ generated by the accelerometers 144, 146 and operable for generating a command signal when the magnitude of the signal $A_2$ exceeds the magnitude of the signal $A_1$ by a predetermined threshold difference corresponding to the acceleration of the piston 74 and traveling sheave 84 relative to the acceleration of the deck 12 after disconnect has occurred.

The objective of the recoil riser preventer system 66 is to bring the weight of the suspended riser and the riser tensioner force equal in magnitude when the riser has lifted off the well head equipment 44 by a sufficient amount. To accomplish this the high pressure supply 98 to the tensioner is shut off and at the same time, high pressure air is introduced to the rod side of the tensioner piston, and the low pressure air/oil reservoir is isolated. With the high pressure supply closed as the tensioner strokes the pressure in the accumulator will decrease. Therefore if the high pressure is applied to the rod side of the piston, the equilibrium piston of the piston can be determined by the magnitude of the pressure on the rod side of the piston. The pressure applied to the rod side of the piston is a function of the riser tension which is applied to the riser and this pressure is called the recoil pressure. The recoil pressure will remain constant for a particular riser tension regardless of the slip joint position.

The recoil system is designed to allow the lower marine riser to lift off the BOP stack before the system reaches pressure equilibrium. This allows excursions of the lower marine riser without making contact with the BOP stack.

All of the valves are designed to actuate at the same time. They are solenoid piloted, air actuated valves.

Once the recoil riser prevention system has been activated and the system has reached equilibrium, the tensioners will still allow relative motion between the riser and the vessel. By closing off the reservoir 98, the system is placed in an "air lock" which means relative motion can take place by the tensioner compressing the air in the tensioner accumulator. The motion is limited but will provide adequate heave compensation for the system during vessel heaves. This arrangement provides a substantial advantage in that the marine riser can be merely disconnected and hung off with heave compensation from the drilling platform for as long a period as may be desired or necessary. For example, in the event of severe weather conditions, it might become necessary to disconnect the riser in order to prevent damage to the riser or riser tensioner system because of severe heaving of the vessel or because of the inability of the drilling platform to remain on station. In such a circumstance it is advantageous to use the heave compensation features of the riser recoil preventer system to retract the riser to a safe position above the well head equipment and suspend or hang off the riser with heave compensation beneath the drilling platform until weather conditions improve rather than completely recovering, disassembling and storing the riser sections and then re-deploying the riser after weather conditions have improved.

Figure 4:
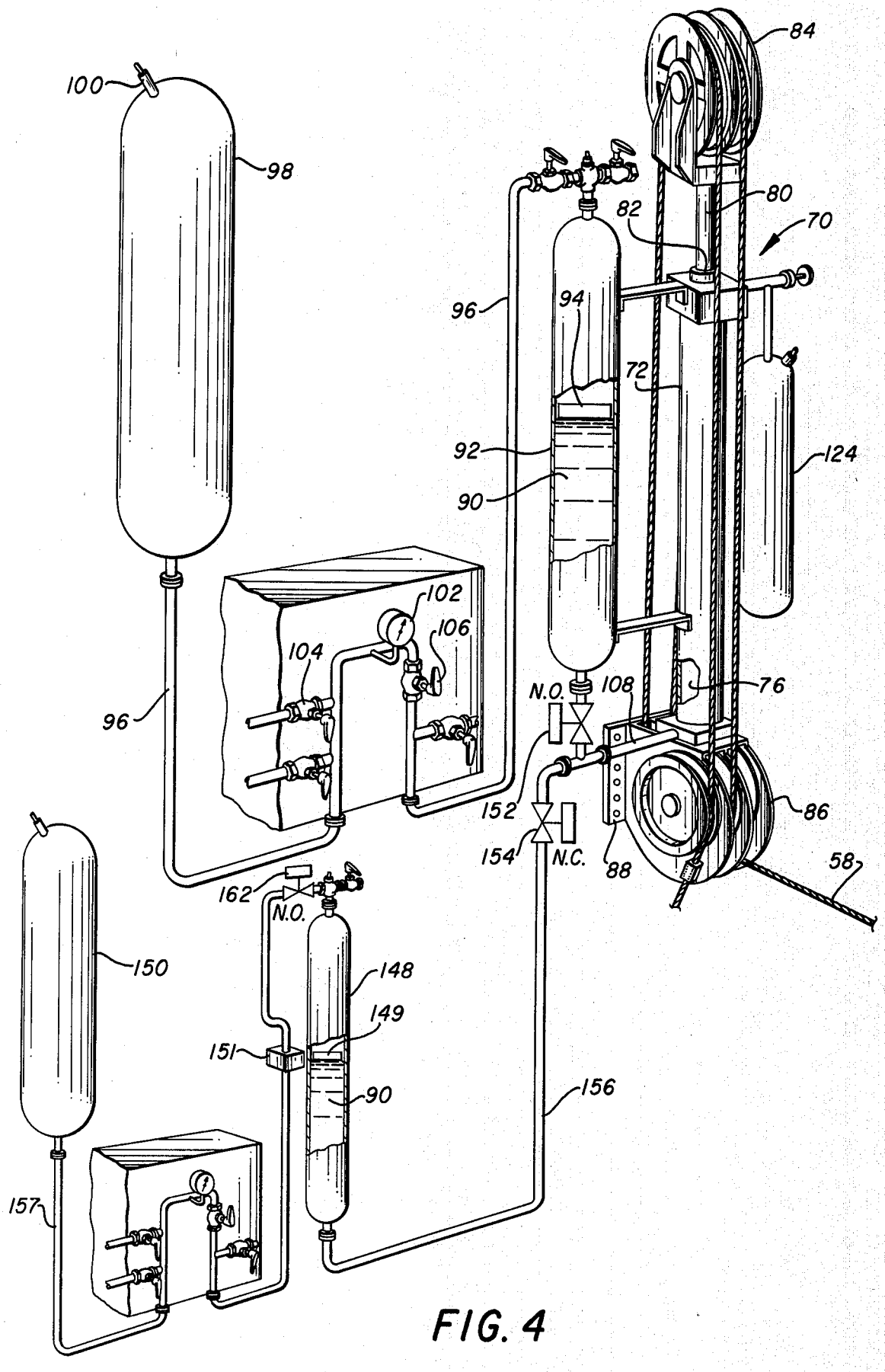
FIG. 4 is an isometric view of an alternate embodiment of the present invention.
Figure 6:
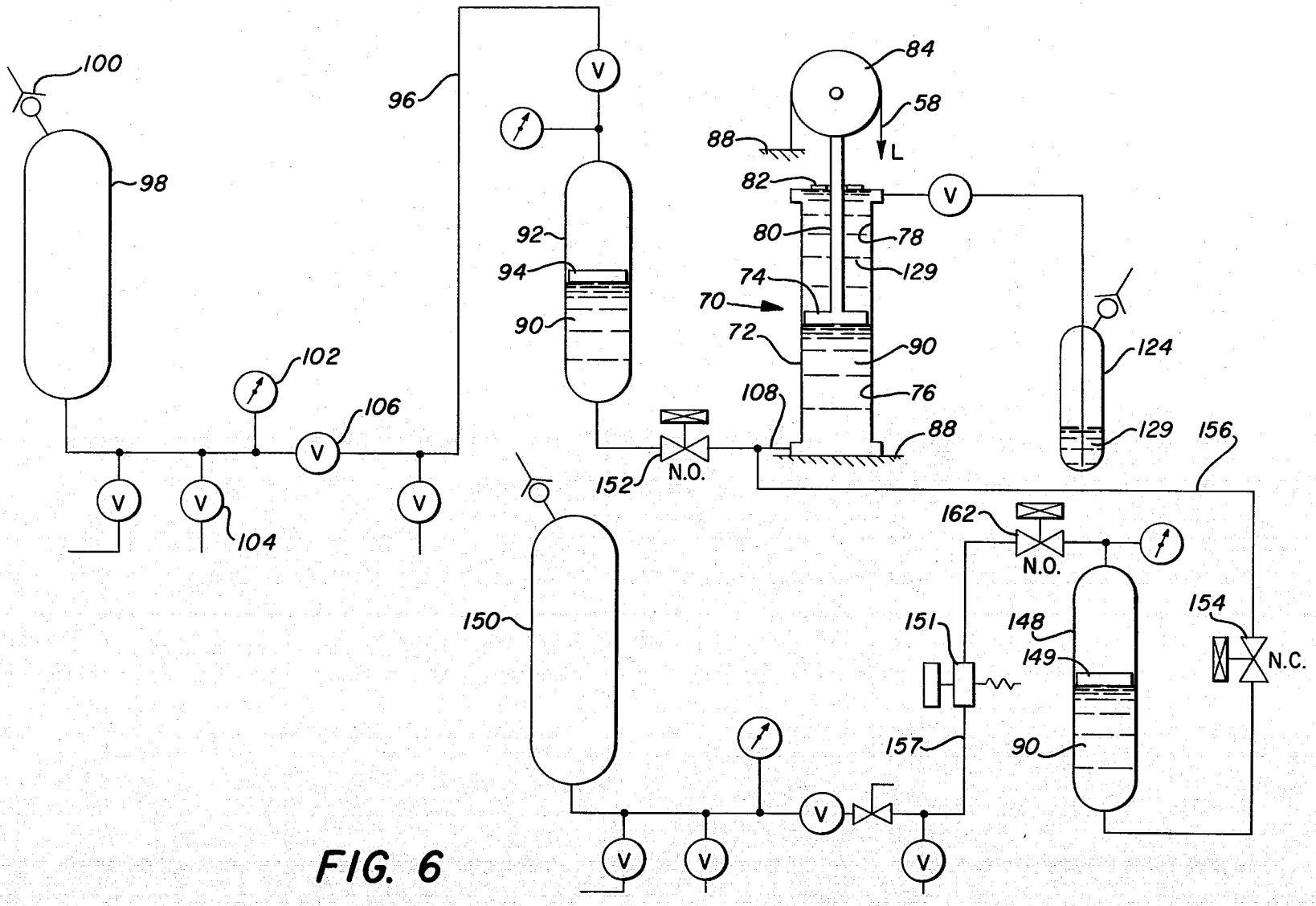
FIG. 6 is a schematic diagram of the apparatus shown in FIG. 4.

Referring now to FIGS. 4 and 6, an alternate embodiment of the tensioner and riser recoil preventer system is illustrated. According to this arrangement, the lifting force applied to the riser string is substantially reduced by substituting an accumulator 148 connected to a compressed gas reservoir 150. The recoil pressure is established by a regulator 151. The regulator 151 may instead be connected to the reservoir 98 thereby eliminating the auxiliary reservoir 150 if desired. Upon disconnection of the riser, the high pressure accumulator 92 is locked out by the actuation of a normally open pilot operated valve 152 which connects it to the hydraulic pressure chamber 76. The accumulator 148 is connected to energize the high pressure chamber 76 by actuation of a normally closed pilot operated valve 154. In this arrangement, a first volume of compressed gas is contained within the primary reservoir 98 and accumulator 92 at a pressure level which is sufficient to maintain the desired tension loading on the marine riser while it is connected to the well head equipment, and a second volume of compressed gas is contained within the reservoir 150 and accumulator 148 at a pressure level which is less than the pressure level of the gas in the primary reservoir 98 but which is sufficient to retract the riser upon disconnection of the riser from the well head equipment and to maintain the suspended riser substantially in equilibrium at the retracted position as the drilling platform 10 heaves and falls in response to wave movements.

The pressure of the compressed air in the auxiliary accumulator 148 is maintained at a desired level by means of the regulator 151. The pressure is maintained at a level which is slightly greater than the force level required to support the riser 52 in equilibrium beneath the floating drilling platform 10. The pressurized hydraulic fluid 90 is conveyed through a hydraulic pressure line 156 to the pressure chamber 76. Compressed air is conveyed to the accumulator 148 through a pneumatic pressure line 157 and a normally open pilot operated valve 162. In response to actuation of the valves 152, 154 and 162, the primary accumulator 92 is locked out with respect to the low pressure chamber 76 and in its place is substituted the accumulator 148 which is also locked out with respect to the auxiliary compressed air source 150. Because the pressure of the compressed air in the auxiliary accumulator 148 was previously maintained by the regulator 151 at a pressure level slightly greater than that required to maintain the riser in suspended equilibrium, the piston will stroke as hydraulic fluid 90 is discharged through the pressure line 156 into the chamber 76, thereby causing retraction of the riser as the compressed air in the accumulator 148 expands, with the pressure level diminishing to the equilibrium point at which it exactly offsets the suspended riser load. With this arrangement, heave compensation is provided in addition to the retraction of the riser and the prevention of a violent collision of the slip joint 56 against the rotary table 40.

It will be apparent to those skilled in the art that the auxiliary reservoir 150 may be eliminated by connecting the pneumatic pressure line 157 directly to the pneumatic pressure line 96 of the primary reservoir 98 and accumulator system.

From the foregoing description it will be apparent that the present invention in its various embodiments provides a versatile and robust motion compensating apparatus for maintaining a substantially constant tension load on a riser during a drilling or production mode of operation and upon disconnection for retracting the riser and supporting it with heave compensation while preventing a violent collision of the riser against the floating drilling platform. This motion compensating arrangement therefore permits drilling activities to be carried out at greater ocean depths and in heavier seas with less risk of damage than has been possible with conventional motion compensating systems.

The particular details of construction disclosed herein are, of course, only illustrative and other equivalent structures may be utilized without departing from the scope of the invention as defined by the appended claims.

What is claimed is:

1. Apparatus for applying tension to a marine riser during a tensioning mode of operation and for relieving the tension during a disconnect mode of operation comprising, in combination:

cylinder means having a housing and a movable piston dividing the housing into a low pressure and a high pressure hydraulic chamber;

a rod connected to the piston for driving a load in response to pressurization of the high pressure chamber;

traveling sheave means mounted on the piston rod;

a power transmission cable disposed in reeved engagement with the traveling sheave means for applying a lifting force on the riser;

a first hydraulic accumulator connected in fluid communication with the high pressure chamber for supplying hydraulic fluid to and for receiving hydraulic fluid from the high pressure chamber in response to changes in its volume;

a second hydraulic accumulator connected in fluid communication with the low pressure chamber for supplying hydraulic fluid to and for receiving hydraulic fluid from the low pressure chamber in response to changes in its volume;

a first reservoir of compressed gas connected in fluid communication with the first hydraulic accumulator for pressurizing the hydraulic fluid in the first accumulator;

a second reservoir of compressed gas having an inlet port connected in fluid communication with the first reservoir and having an outlet port connected in fluid communication with the low pressure chamber for applying a pneumatic pressure load on the piston in combination with the low pressure hydraulic load in opposition to the high pressure hydraulic load;

first valve means connected intermediate the first reservoir and the first hydraulic accumulator for admitting compressed gas into the first accumulator during the tensioning mode of operation and for sealing the first accumulator during the disconnect mode of operation; and, second valve means connected intermediate the second reservoir and low pressure chamber for sealing the outlet port of the second reservoir during the tensioning mode of operation and for admitting compressed gas into the low pressure chamber during the disconnect mode of operation.

2. The riser tensioner apparatus as defined in claim 1, the combination further including a regulator connected intermediate the first reservoir and the second reservoir for maintaining the pressure of the second reservoir at a predetermined lower level relative to the pressure of the first reservoir.

3. In combination:

an offshore production facility including a floating platform stationed above an ocean floor production site in which well head equipment is embedded;

a marine riser connected to the well head equipment and extending from the production site to the floating platform;

a telescoping joint coupling the riser to the floating platform;

a tensioner assembly coupled intermediate the platform and marine riser for applying a tension load on the riser, the tensioner assembly including a hydraulic cylinder having a housing member attached to the platform, a movable piston dividing the housing member onto a high pressure hydraulic chamber and a low pressure hydraulic chamber, a rod connected to the piston and coupled to the riser for applying a tension load to the riser in response to pressurization of the high pressure chamber; and, a riser recoil preventer assembly including a reservoir of compressed gas and valve means connected intermediate the compressed gas reservoir and low pressure chamber for selectively opening a pneumatic circuit between the reservoir and low pressure chamber for applying a pneumatic over hydraulic pressure load on the piston in opposition to the high pressure hydraulic load, thereby relieving the tension load on the riser and limiting the displacement of the telescoping joint to prevent its collision with the platform in response to disconnection of the marine riser from the well head equipment.

4. In a tensioner assembly for applying a tension load to a marine riser connected to well head equipment and extending to a floating platform in an offshore production site, the tensioner assembly being of the type including a hydraulic cylinder having a housing, a piston dividing the housing into a high pressure hydraulic chamber and a low pressure hydraulic chamber, and a rod attached to the piston for applying a tension load to the marine riser, the combination with the hydraulic cylinder of a reservoir of compressed gas and valve means connected intermediate the reservoir and low pressure chamber for selectively applying a pneumatic over hydraulic load to the piston in opposition to the hydraulic load when the riser is disconnected from the well head equipment.

5. In a tensioner assembly for applying a tension load to a marine riser connected to well head equipment and extending to a floating platform in an offshore production site, the tensioner assembly being of the type including a hydraulic cylinder having a housing, a piston coupled to the housing defining a pressure chamber that changes in volume with movement of the piston relative to the housing, a rod attached to the piston for applying a tension load to the marine riser in response to pressurization of the pressure chamber, a first hydraulic accumulator connected in fluid communication with the pressure chamber for maintaining hydraulic fluid in the pressure chamber under pressure, and a first reservoir of compressed gas connected in fluid communication with the first hydraulic accumulator for maintaining a pressure load on the hydraulic fluid, the combination with the hydraulic cylinder of a second hydraulic accumulator connected in fluid communication with the pressure chamber, a second reservoir of compressed gas connected in fluid communication with the second accumulator, a first valve connected intermediate the first hydraulic accumulator and pressure chamber for selectively opening and closing a fluid circuit from the first hydraulic accumulator to the pressure chamber, and a second valve connected intermediate the second hydraulic accumulator and pressure chamber for selectively opening or closing a fluid circuit from the second hydraulic accumulator to the pressure chamber, a first volume of compressed gas disposed in the first reservoir and accumulator at a pressure level sufficient to maintain tension loading on the marine riser while it is attached to the well head equipment, and a second volume of compressed gas disposed in the second reservoir and second hydraulic accumulator at a pressure level less than the pressure level of the first reservoir but which is sufficient to retract the riser upon disconnection of the riser from the well head equipment and maintain the suspended riser substantially in equilibrium at the retracted position as the platform heaves and falls in response to wave movements.

* * * * *